US006625910B2

(12) United States Patent
Ching et al.

(10) Patent No.: US 6,625,910 B2
(45) Date of Patent: Sep. 30, 2003

(54) ELECTRIC IRON WITH EXCHANGEABLE RESERVOIR

(75) Inventors: Boon-Khian Ching, Singapore (SG); Ban Nee Choo, Singapore (SG); Arun Sundaram, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/893,041

(22) Filed: Jun. 27, 2001

(65) Prior Publication Data

US 2002/0050081 A1 May 2, 2002

(30) Foreign Application Priority Data

Jun. 30, 2000 (SG) ..... 20003657

(51) Int. Cl.[7] ..... D06F 75/22
(52) U.S. Cl. ..... 38/77.3
(58) Field of Search ..... 38/77.3, 75, 77.1, 38/77.5, 77.8; 219/245; 239/274, 305, 310, 398

(56) References Cited

U.S. PATENT DOCUMENTS

| | | | | | |
|---|---|---|---|---|---|
| 2,080,175 | A | * | 5/1937 | Kuno | 38/77.3 |
| 2,817,169 | A | * | 12/1957 | Schott | 38/77.1 |
| 3,101,562 | A | * | 8/1963 | Crawford | 38/77.3 |
| 3,160,969 | A | * | 12/1964 | Ensley | 38/77.3 |
| 3,685,182 | A | * | 8/1972 | Davidson et al. | 38/77.3 |
| 5,526,595 | A | * | 6/1996 | Daulasim et al. | 38/77.8 |

FOREIGN PATENT DOCUMENTS

| | | | | |
|---|---|---|---|---|
| FR | 2488296 | * | 2/1982 | 38/77.3 |
| JP | 0171594 | * | 9/1984 | 38/77.3 |

* cited by examiner

*Primary Examiner*—Ismael Izaguirre
(74) *Attorney, Agent, or Firm*—Ernestine C. Bartlett

(57) ABSTRACT

An electronic iron includes a housing (1), a sole plate (2), a heater (3) for heating the sole plate, an exchangeable reservoir (4) for containing a liquid (5), a nozzle (6), and a pump (14) for delivering the liquid to the nozzle. To reduce the risk of the nozzle becoming clogged or contaminated, the nozzle (6) is an integral fixed part of the exchangeable reservoir (4).

12 Claims, 3 Drawing Sheets

ELECTRIC IRON WITH EXCHANGEABLE RESERVOIR

Figure 1:
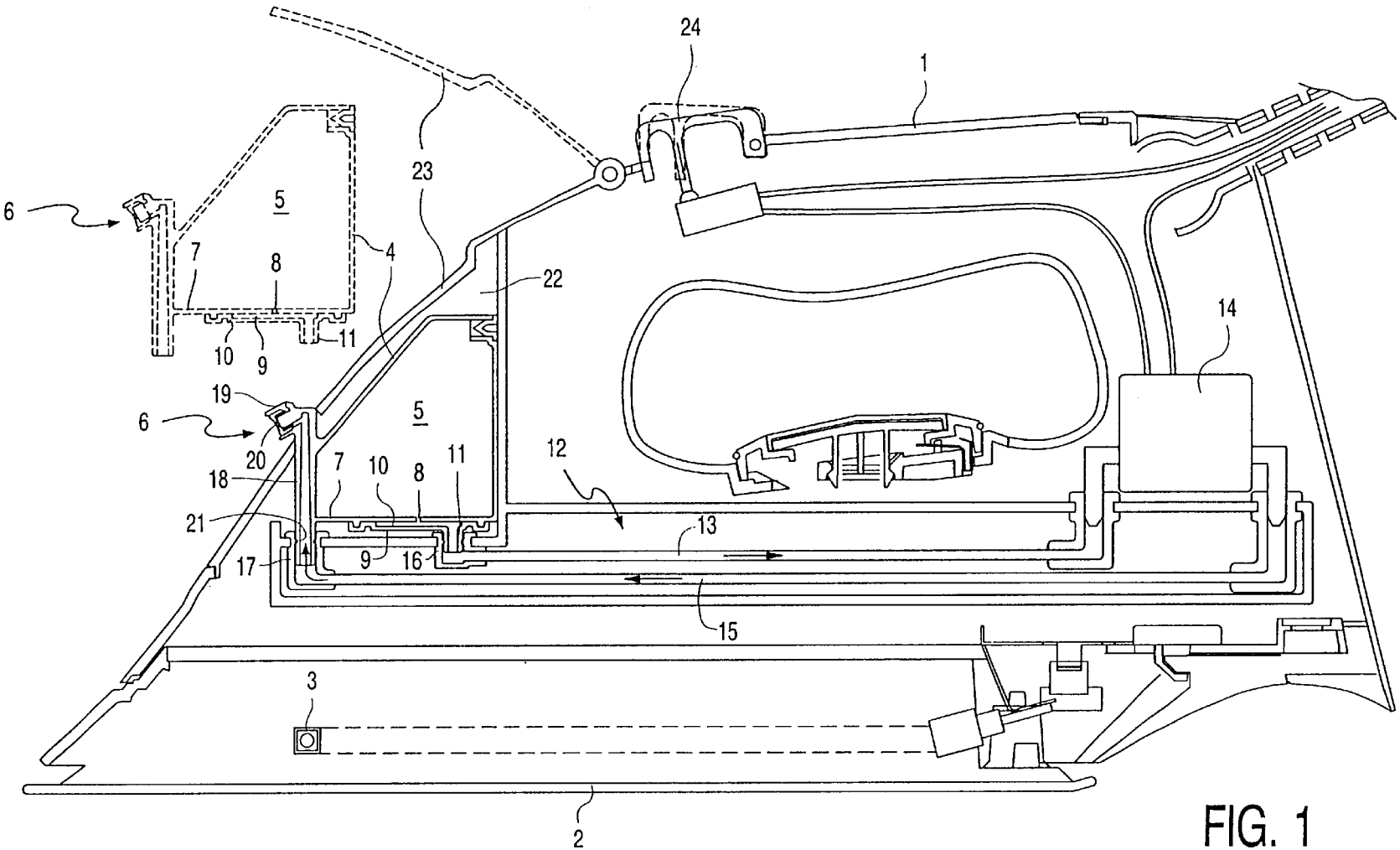

The invention relates to an electric iron comprising a housing, a sole plate, heating means for heating said sole plate, an exchangeable reservoir for containing a liquid, nozzle means, and a pump for delivering said liquid to said nozzle means.

Such an electric iron is known from WO 99/27176. With this iron it is possible to spray an additive liquid on the fabric before it is ironed. Additive liquids can be used e.g. for achieving a starching effect or wrinkling resistance, or for making cloth hydrophilic or hydrophobic. The additive liquid is contained in the exchangeable reservoir. When the pump is started, additive liquid is sucked from the exchangeable reservoir via a supply tube and pumped to a spraying nozzle means. The nozzle means is constructed as a fixed part of the housing. The use of another exchangeable reservoir containing a different kind of additive liquid means that the same nozzle is used for spraying different kinds of liquids having different properties, such as particle size and viscosity. Different particle sizes and viscosities may cause problems in spraying, at least the spraying effect will not be optimal. Moreover, the nozzle means and in particular the aperture(s) thereof are subject to clogging and contamination owing to the use of additive liquids. The extent of clogging and contamination depends inter alia on the affinity of the active ingredients of the additive liquid to the surfaces forming the liquid path and aperture, as well as the solubility of the active ingredients. It is in particular additive liquids containing polymers of high affinity to surfaces forming the aperture and polymers of low solubility or non-water-soluble polymers which tend to cause problems. Cleaning the aperture(s) to get rid of contamination is very difficult, especially after intensive usage in which the exchangeable reservoir was replaced several times.

The object of the invention is to provide an electric iron in which exchangeable reservoirs containing additive liquids can be used without the risk of the above problems arising.

According to the invention, this object is achieved in that the exchangeable reservoir is provided with the nozzle means.

Each exchangeable reservoir thus has its own nozzle means. The nozzle means can be designed such that it is adapted to the kind of liquid of the exchangeable reservoir. For example, the size of the aperture of the nozzle can be adapted to suit the additive liquid viscosity, so that a fine spray of mist is obtained from each liquid. The design or material choice of the nozzle can be optimized to suit the additive liquid so as to reduce or eliminate the build-up of active ingredients. The risk that the nozzle will become clogged or contaminated is substantially reduced.

It is to be noted that U.S. Pat. No. 3,300,884 discloses an electric iron which has a construction for spraying liquid starch. To that end, the iron is provided with a cavity into which a container of pressurized liquid starch can be inserted. The container itself is provided with nozzle means. However, this known iron does not have a pump for delivering the liquid to the nozzle means. Instead, the internal pressure of the liquid is used for delivering the liquid starch to the nozzle means resulting in spraying of the liquid. The disadvantage of this is that the internal pressure will drop as the contents of the container are being emptied, which causes a deteriorating spraying effect.

Preferably, the exchangeable reservoir is a disposable cartridge. The pressure of the nozzle means on the disposable cartridge has the advantage that each time the disposable cartridge is empty and should be replaced by a new, full cartridge the nozzle means will be new too and thus clean. The risk of clogging or contamination is substantially reduced.

A further preferred embodiment is characterized in that the iron comprises a further reservoir, fixedly arranged inside the housing, for containing a second liquid, said pump delivering a mixture of the two liquids to the nozzle means. Generally the second liquid is water, which is used to dilute the additive liquid before it is delivered to the nozzle means, so that the exchangeable reservoir or cartridge can contain an additive liquid in concentrated form.

The invention also relates to an exchangeable reservoir intended for use in the iron and having characteristics as described in the claims.

These and other aspects of the invention will be apparent from and elucidated with reference to the embodiments described hereinafter.

IN THE DRAWINGS

Figure 2:
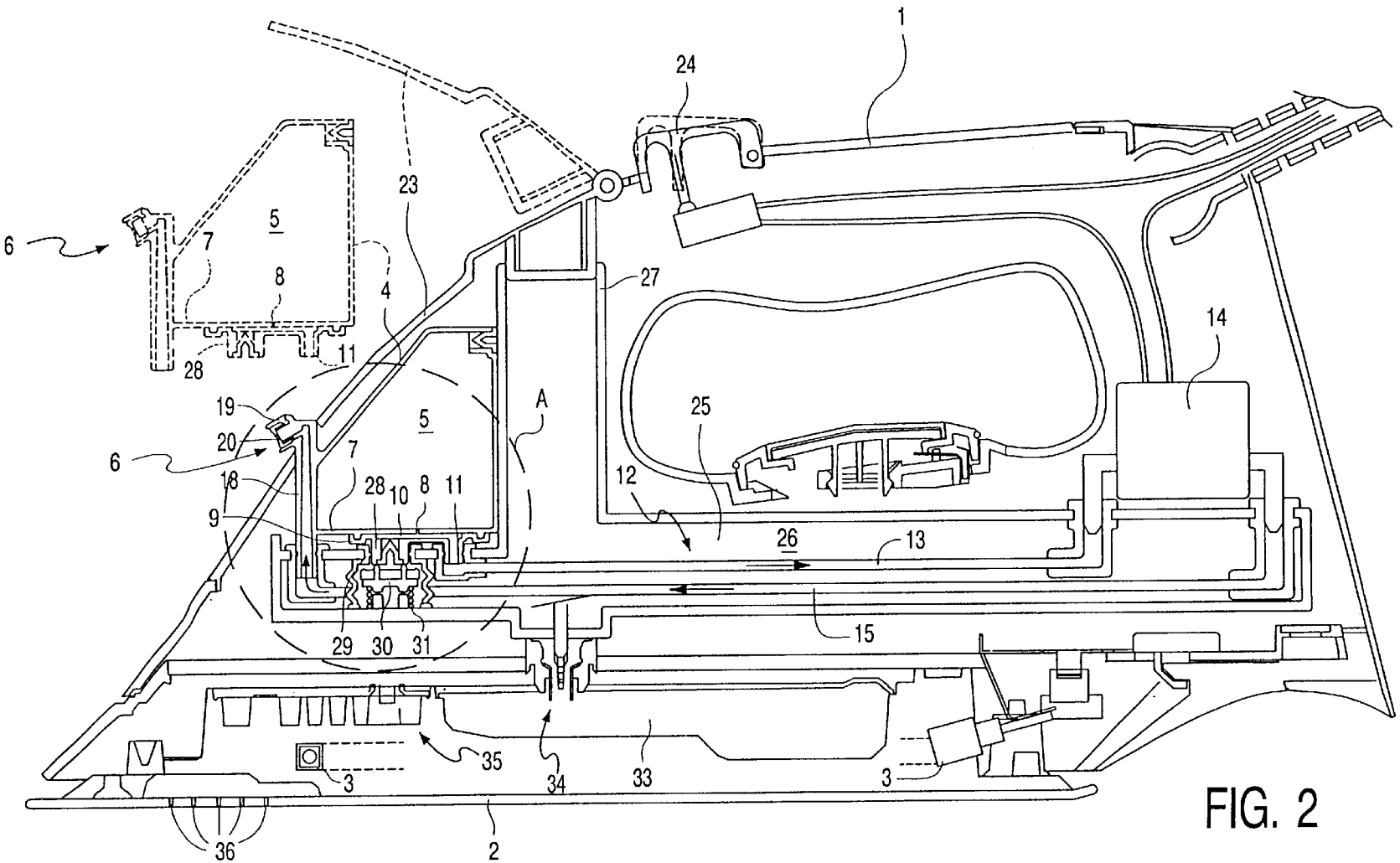
Figure 3:
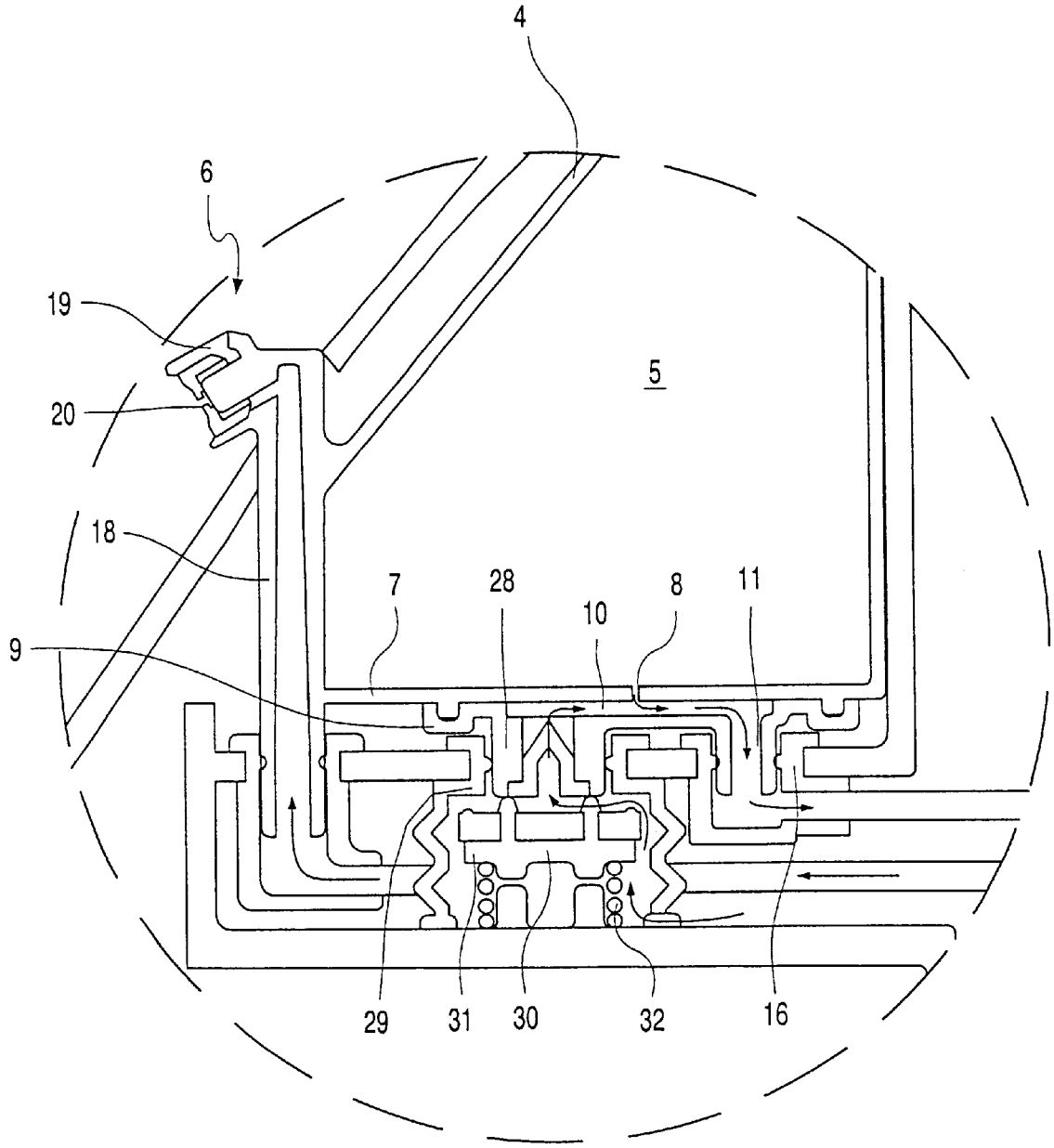

FIG. 1 is a cross-sectional view of an iron in which an exchangeable reservoir is arranged according to a first embodiment, FIG. 2 is a cross-sectional view of an iron in which an exchangeable reservoir is arranged according to a second embodiment, and FIG. 3 is an enlarged cross-sectional view of a detail of FIG. 2 as indicated with circle A.

An iron according to the invention as shown in FIG. 1 comprises a housing 1, a sole plate 2, a heating element 3 for heating the sole plate, an exchangeable reservoir 4 for containing a liquid 5, and a spraying nozzle means 6. The exchangeable reservoir 4 may be a kind of cassette or cartridge with a hard synthetic resin housing. The liquid 5 in the exchangeable reservoir is a so-called additive liquid of a certain particle size and with a certain viscosity. The bottom 7 of the exchangeable reservoir 4 is provided with an outlet 8 for the liquid 5. A coupling piece 9 is connected at the lowerside of the bottom 7, which coupling piece has a duct 10 of which an inlet is in communication with the outlet 8 of the reservoir 4 and of which an outlet terminates in an outlet tube 11. The coupling piece 9 may be integral with the cartridge in the first preferred embodiment. The iron comprises a delivery system 12 for delivering the liquid 5 from the exchangeable reservoir 4 to the nozzle means 6 in order for it to be sprayed on the cloth to be ironed. The delivery system comprises a first channel 13, an outlet thereof being connected to an inlet of an electric pump 14 arranged inside the housing of the iron, and a second channel 15, an inlet thereof being connected to an outlet of the pump 14. An inlet of the channel 13 is provided with a coupling sleeve 16 for coupling to the outlet tube 11 of the coupling piece 9. An outlet of the second channel 15 is provided with a coupling sleeve 17. According to the invention, the exchangeable reservoir 4 is provided with the nozzle means 6. The nozzle means comprises a nozzle tube 18 terminating in a nozzle 19 having an aperture 20. An inlet of the nozzle tube forms a coupling tube 21 for coupling to the coupling sleeve 17 of the second channel 15. The exchangeable reservoir 4 can be inserted into a cavity 22 of the iron. A pivotable cover 23 can close the cavity 22. When an additive spray is desired, the user starts the pump 14 by pressing a knob 24. The pump sucks the additive liquid 5 from the reservoir 4 into the channel 13 and pumps it via the channel 15 and the nozzle tube 18 towards the nozzle 19.

It is also possible to connect the outlet 8 of the reservoir 4 directly to the nozzle tube 18 and pressurizing the liquid in the reservoir 4 by means of air or water. If pressure is built up by means of water, mixing of water and additive liquid should be avoided, e.g. by means of a flexible membrane provided in the reservoir to separate the additive liquid from the water. The exchangeable reservoir 4 including the nozzle means 6 can be implemented as a disposable cartridge, so that every new cartridge is provided with clean nozzle means.

In the example of FIG. 2, the iron is provided with a second reservoir 25 fixedly arranged in the iron. The second reservoir may contain a different liquid 26 which is to be mixed with the additive liquid 5 of the exchangeable reservoir 4. Usually the liquid in the second reservoir will be water. Mixing the additive liquid 5 with the water means that the additive liquid is diluted, so that the additive liquid in the exchangeable cartridge 4 can be in a concentrated form, thereby keeping the cartridge 4 as small as possible. The second reservoir 25 has a filling funnel 27, which can be optionally closed by the pivotable cover 23. The coupling piece 9 comprises an inlet tube 28 for the water which is to enter the duct 10 (see FIG. 3). An outlet of the second reservoir 25 is provided with a coupling sleeve 29 for coupling to the inlet tube 28. When the additive reservoir 4 is removed from the iron, a valve 30 will close off the outlet of the second reservoir 26. A sealing part 31 seals off the lower side 32 of the sleeve 29 under the influence of the spring 32. When the additive reservoir 4 is inserted, the inlet tube 28 of the coupling piece 9 pushes the valve 30 downward against the force of the spring 32 into an open position. The pump 14 is started with the push button 24 when a user wants to spray liquid on the fabric. Liquids from both reservoirs 4 and 25 are sucked into the duct 10 of the coupling piece 9 and conveyed through the outlet 11 and the tube 13 to the pump 14 and from there through the tube 15 and the nozzle tube 18 to the nozzle 19.

The iron in this second example is a steam iron and is accordingly provided with a steam chamber 33, steam dosing means 34, a steam distribution channel system 35, and outlet ports 36 in the sole plate 2. The water can be used for steaming as well as for diluting the additive liquid for spraying.

What is claimed is:

1. An electric iron comprising a housing, a sole plate, heating means for heating said sole plate, an exchangeable reservoir for containing a liquid, nozzle means, and a pump for delivering said liquid to said nozzle means, characterized in that the exchangeable reservoir is provided with said nozzle means, characterized in that the iron comprises a further reservoir, fixedly arranged inside the housing, for containing a second liquid, said pump delivering a mixture of the two liquids to the nozzle means.

2. An electric iron as claimed 1, characterized in that the exchangeable reservoir is a disposable cartridge.

3. An electric iron as claimed in claim 2, wherein the pump is electric.

4. An electric iron as claimed in claim 1, wherein the iron comprises a recess for receiving the reservoir substantially within the housing.

5. An electrical iron comprising a housing, a sole plate, heating means for heating said sole plate, an exchangeable reservoir for containing a liquid, nozzle means, and a pump for delivering said liquid to said nozzle means, characterized in that the exchangeable reservoir is provided with said nozzle means, wherein the pump is exterior to the reservoir and the iron further comprises a delivery system for transporting the liquid from the reservoir to the pump and back from the pump to the nozzle.

6. The iron of claim 5, further comprising at least one coupling piece, integral with the reservoir, for coupling the reservoir and the nozzle with the delivery system.

7. An electric iron as claimed 5, characterized in that the exchangeable reservoir is a disposable cartridge.

8. An electric iron as claimed in claim 5, wherein the pump is electric.

9. An electric iron as claimed in claim 5, wherein the iron comprises a recess for receiving the reservoir substantially within the housing.

10. A unit for use in an electric iron, the unit comprising:

an exterior shape suitable for placement into an removal from a corresponding receiving means of the electric iron;

An interior reservoir for holding fluid;

a nozzle for dispensing the fluid onto a surface to be ironed;

an outlet for allowing passage of the fluid from the interior reservoir to a pump of the iron, which pump is external to the unit; and an inlet for allowing passage of the fluid from the pump of the iron to the nozzle.

11. The unit of claim 10 adapted as a disposable cartridge.

12. The unit of claim 10, wherein the inlet is also arranged for allowing passage of a second fluid from a second reservoir in the iron.

* * * * *